US005119046A

United States Patent [19]

Kozlowski, Jr. et al.

[11] Patent Number: 5,119,046

[45] Date of Patent: Jun. 2, 1992

[54] ASYMMETRICALLY SHAPED JACKETED COAXIAL ELECTRICAL TRANSMISSION LINE

[75] Inventors: Edward L. Kozlowski, Jr., Elkton, Md.; Stephen McGrath, Newark, Del.

[73] Assignee: W. L. Gore & Associates, Inc., Newark, Del.

[21] Appl. No.: 622,109

[22] Filed: Dec. 4, 1990

[51] Int. Cl.[5] ..... H01P 3/06; H01B 11/18

[52] U.S. Cl. ..... 333/1; 174/112; 174/117 R; 333/243

[58] Field of Search ..... 174/36, 112, 117 R; 333/1, 243, 244, 245

[56] References Cited

U.S. PATENT DOCUMENTS

| | | | |
|---|---|---|---|
| 2,218,830 | 10/1940 | Rose et al. | 174/112 X |
| 2,232,085 | 2/1941 | Troche | 174/112 |
| 3,748,371 | 7/1973 | Krook et al. | 174/112 X |
| 4,588,852 | 5/1986 | Fetterolf et al. | 174/36 |
| 4,943,688 | 7/1990 | Van Deusen et al. | 174/36 X |
| 5,038,001 | 8/1991 | Koegel et al. | 174/112 |

*Primary Examiner*—Paul Gensler
*Attorney, Agent, or Firm*—Gary A. Samuels

[57] ABSTRACT

An asymmetrically shaped jacketed coaxial electrical cable having a drain wire in which the drain wire is aligned parallel to the asymmetric edge or corner of the cable for fast and accurate termination of the cable.

10 Claims, 3 Drawing Sheets

ASYMMETRICALLY SHAPED JACKETED COAXIAL ELECTRICAL TRANSMISSION LINE

FIELD OF THE INVENTION

This invention pertains to high-speed coaxial electrical cables having a drain wire and an extruded jacket.

BACKGROUND OF THE INVENTION

High-speed coaxial electrical cables are often manufactured which include conductive drain wires in electrical contact with the outer conductive shielding thread. The cables and drain wires are jacketed together as a unit with an extruded protective polymer jacket. When utilized for the intended purpose of making signal connections and associated shield and drain wire connections, it is usually difficult for one terminating the cable, by particularly an automatic termination method, to establish on which side of the cable the drain wire is located so that the drain wire is not cut and may be easily found for proper termination. The prior art has shown that asymmetrically shaped coaxial cables allow for the drain wire to be located easily for termination. Industry trends are requiring the use of higher speed and smaller size coaxial cables. These new requirements are very difficult to meet with current art. Current art utilizes a tape wrapped or extruded porous insulation over the center conductor in order to achieve the velocity of signal propagation requirements. Porous insulation is susceptible to crushing when under pressure which could lead to coaxial cables having lower signal propagation velocity. The current shielding method is one in which the shield is tape wrapped or spirally wrapped around the cable core, methods which do not allow the drain wire to be located consistently and predictably. The customary methods for applying an outer protective jacket to the cable do not readily allow extrusion of a jacket other then a drawn down jacket sleeve on the cable core. This "sleeving" method of extrusion thus will not produce a cable profile or shape having distinct corners or edges.

SUMMARY OF THE INVENTION

To solve the above difficulties, a pressure extrusion method has been devised which will shape and mold an outer protective jacket having a profile of distinct corners or edges onto a coaxial cable and drain wire taken as a unit. A jacket having an odd number of corners or edges of irregular distance apart can be applied to the cable and drain wire such that the drain wire is aligned with a readily identifiable edge or corner of the jacket, that edge or corner differing from the remaining edges or corners of the jacket in being more sharply peaked than the other edges or corners. The cable may be easily terminated to a connector by hand or machine methods since the location of the drain wire is beneath or is in known or predictable relationship to the differently shaped edge or corner of the cable.

An odd number of sides to the jacket, such as preferably 3, 5, or 7, will allow molding of one corner or edge of the jacket to be of different size or shape than the others and easily identifiable, although irregular shapes having an even number of sides can be molded as well as shapes having an odd or even number of curved rather than planar sides. The drain wire is always placed beneath or aligned in predictable relationship with that differently shaped edge or corner. It is also preferable that two sides of the jacket be parallel and planar so that more than one cable may be joined into a flat multiconductor cable. The jacketing material utilized in the invention is preferably an extrudable thermoplastic polymer.

To allow proper placement of a drain wire parallel to the coaxial core of the cable under the conductive shield of the cable, the cigarette method of applying a strip of, for example metallized polymer tape, is utilized. By cigarette wrap is meant, as is customary in the art, the wrapping of a sheet of conductive tape lengthwise about the insulated center conductor, the edges of the strip overlapping each other down the length of the cable to closely enfold the insulated center conductor. The cigarette wrap method prevents the bridging of the tape with consequent air gaps between the juncture of the drain wire and cable insulation such that a drain wire can be firmly located parallel to the center conductor and a readily identifiable edge or corner and closely enfolded by the shield. A helical wrap method of applying the conductive tape will always bridge and will not hold a drain wire parallel to the center conductor.

A barrier layer of non-porous polymer, preferably a fluorinated polymer, is preferably applied over the insulation surrounding the center conductor to provide a smooth surface for easy application of the shield without its wrinkling or collapse under manufacturing pressures or tensions. A non-porous polymer barrier is needed to provide a member for absorbing the pressures delivered onto the coaxial cable during extrusion to meet the high electrical requirements for the finished cable. This construction is necessary for electrical cables that exhibit a signal propagation velocity of at least 75% of the velocity of light, the velocity being determined by time domain reflectometry methods, for example.

DETAILED DESCRIPTION OF THE INVENTION

The invention is now described in detail with reference to the drawings in order to more clearly and carefully delineate the scope of the invention. The cables of the invention require an irregular shape such that one edge or corner of the jacket noticeably differs in appearance or size from any other edges or corners on the jacket of the cable. This distinctive edge is usually located just above the drain wire of the cable and serves to identify the position in the cable of the drain wire for easy access for termination of the cable during installation of the cable for its intended use, but the drain wire may be predictably located in another corner of the jacket in known relationship to the asymmetric corner or edge.

Figure 1:
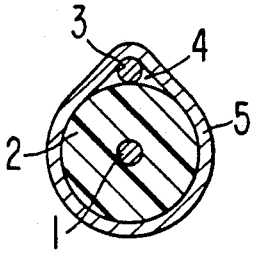
FIG. 1 illustrates in a cross-sectional view a cable having a tape-wrapped shield.
Figure 2:
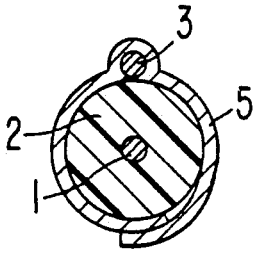
FIG. 2 shows a cross-sectional view of a cable having cigarette-wrapped shield.

FIGS. 1 and 2 provide cross-sectional views of sample cables illustrative of the differences between tape-wrapped conductive shielding and cigarette-wrapped shielding as described above. The cigarette-wrapped shield must be used in order to position the drain wire 3 in the peak 8 of the jacket profile parallel to the center conductor (see FIGS. 3–6). The tape-wrap method does not allow location, positioning, and holding the drain wire 3 in place since the method allows bridging 4 to occur between the shield 5 and the insulation 2 of the core of the cable. Bridging allows drain wire 3 to move sideways out of parallel to the center conductor 1.

Figure 3:
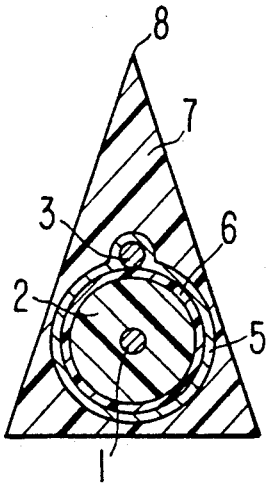
FIGS. 3, 4, 5, 6, and 10 describe in cross-sectional views cables of the invention having three, five, and seven sides and edges or rounded with one edge.
Figure 4:
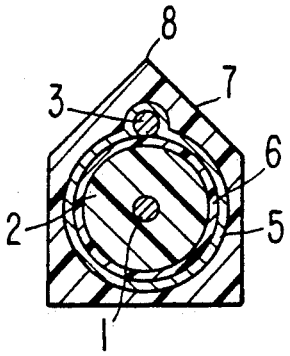
Figure 5:
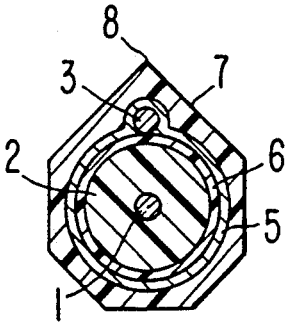

FIGS. 3, 4, and 5 show cross-sectional views of embodiments of the cable of the invention wherein useful 3, 5, and 7 sided irregular odd numbered polygon contoured cable jackets 7 are extruded onto the shielded, insulated cable and drain wire as a unit. The drain wire 3 lies just inside the conductive shield 5 outside the barrier layer 6. Barrier layer 6 is applied by tape-wrap or extrusion to give a smooth outer shell on the main cable insulation 2 while the conductive shield 5 is being applied. Barrier layer 6 prevents shield 5 from collapsing, crinkling, or wrinkling during the process of cigarette-wrapping it onto the cable. Any fluoropolymer may be used for layer 6, a fluoropolymer being necessary to meet high performance electrical requirements for the cable. Examples may include polytetrafluoroethylene (PTFE), copolymer of PTFE and hexafluoropropylene (FEP), polyvinylidene fluoride, polychlorotrifluoroethylene, copolymer of hexafluoropropylene and vinylidene fluoride, copolymer of ethylene and PTFE, copolymer of vinylidene fluoride and chlorotrifluoroethylene, polyperfluoroalkoxy tetrafluoroethylene, and the like.

Figure 6:
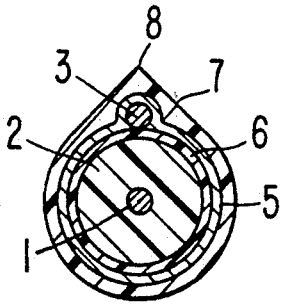

FIG. 6 depicts in a cross-sectional view of an alternatively-shaped jacket on the cable of the invention. The jacket 7 is circularly cylindrical for most of the circumference, but has a peak 8 or edge molded into it above the drain wire 3 which serves the same purpose as an irregular polygonal edge, as shown in FIGS. 3, 4, 5, and 10 to accurately locate from the outside the position of the drain wire 3 for easy termination of the cable.

The shield 5 materials are foil shields generally and may be of conductive metal foils customarily used in the art for shielding, such as copper, copper alloys, metal plated foil, aluminum, or aluminized polymer films, such as aluminized PTFE, polyester, polyimide, or others known to be useful in the art.

Figure 7:
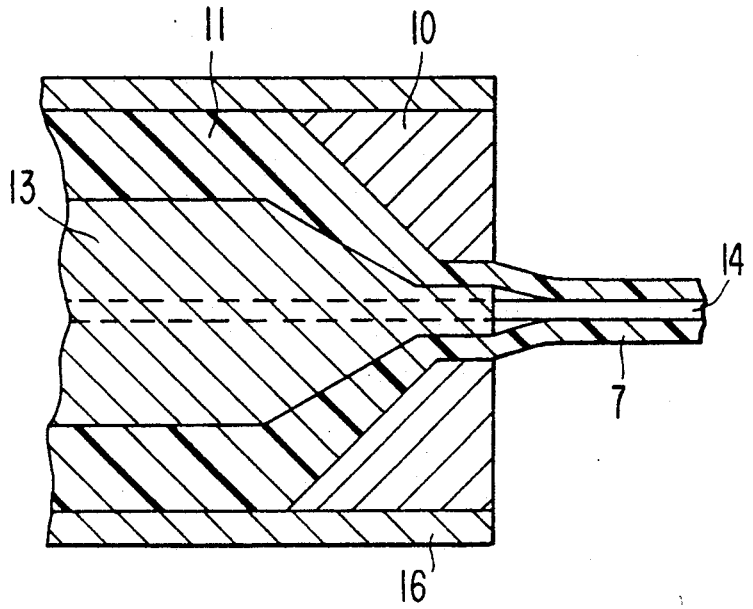
FIG. 7 illustrates in a partial cross-sectional view an extruder for the sleeving method for applying a jacket to a cable core.

FIG. 7 describes a sleeving extrusion apparatus in a cross-sectional view. Molten jacketing polymer 11 is extruded around mandrel 13 through extrusion die 10 onto a cable core 14 (such as shown in cross-section in FIGS. 1–6), comprising center conductor 1, insulation 2, barrier layer 6, drain wire 3, and conductive shielding 5, which is passed through an aperture in mandrel 13 into the orifice of the extruder. At this point, jacket 7 is drawn down onto core 14 (drawing means not shown). Dimensional tolerances required for accurate positioning of drain wire 3 with respect to peak of jacket 7 cannot be reliably performed by the sleeving method, so a new method was needed.

Figure 8:
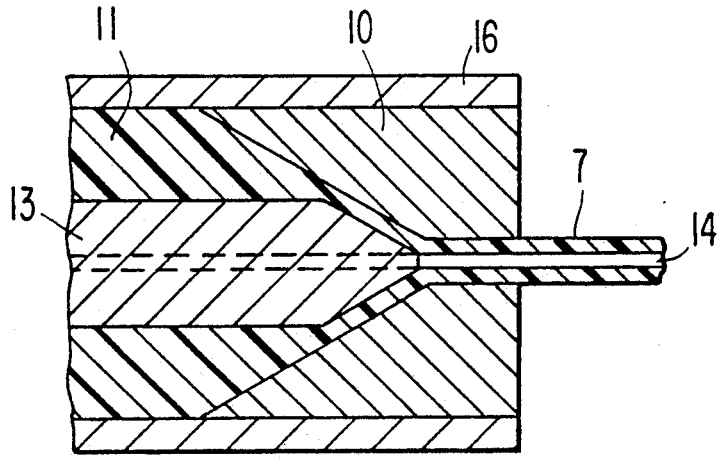
FIG. 8 describes in partial cross-sectional view an extruder for pressure extruding a shaped or profiled jacket on a cable core.

It was found that a pressure extrusion method as depicted in FIG. 8 could be devised which could mold the jacket 7 into definite irregularly shaped and contoured cables wherein a peak 8 could be reliably and accurately molded immediately above ground wire 3 of the cable (see FIGS. 3–6). Pressure molding allowed accurate shaping and contouring of jacket 7 around cable core 14 which could be positioned-controlled while being passed through mandrel 13 and die 10 and encased under pressure in jacket material 11 such that drain wire 3 lay immediately under the irregular peak 8 of the cable jacket. The extruder casing is denoted by the number 16 in both FIGS. 7 and 8. Jacket 7 does not require drawing down on core 14 and encases core 14 tightly.

The materials for jacket 7 may include polyvinyl chloride, urethane rubber, elastomeric polyesters, silicone rubber, and high-temperature resistant fluoropolymers for instance.

Figure 9:
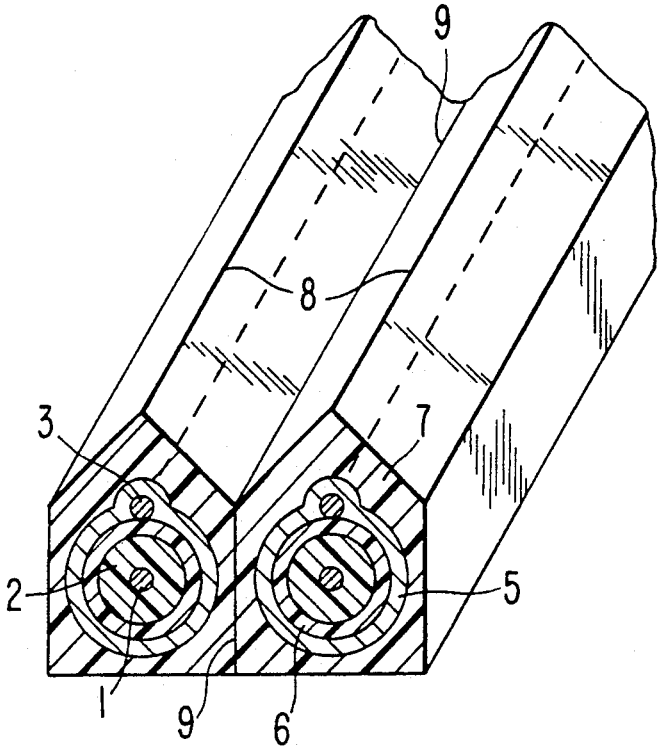
FIG. 9 shows a partial cross-sectional perspective view of two jacketed cables of the invention joined together along planar sides of the jackets to form a flat multiconductor cable having the drain wires positioned accurately for termination of the cable.

FIG. 9 describes two single cables of the invention to be combined into a flat multiconductor coaxial cable by joining them by an adhesive or heat fusion. Where a configuration of cable is selected which has two oppositely placed coplanar sides, as many single cables as needed may be joined thusly into a flat ribbon cable. The cable shown includes center conductors 1, insulation 2, drain wire 3, conductive shielding 5, barrier layer 6, jacket 7, asymmetric peaks 8, and joint line 9.

Figure 10:
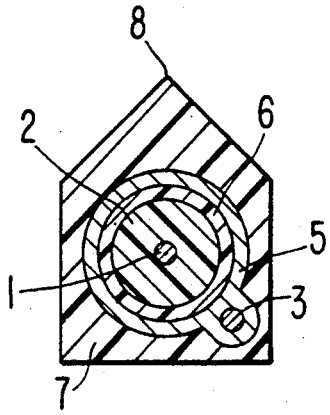

FIG. 10 shows a cross-sectional view of a cable wherein the drain wire 3 is located under a corner or edge in a predictable relationship to asymmetric corner 8.

A shaped jacket on a coaxial cable provides the advantage of eliminating a processing step, reduces the cost of termination in its ease of stripping, provides an increased number of stripping options, accurate location of the drain wire for automatic machine stripping, and can be shaped or profiled for easy placement in a jig for automatic machine termination. Longer processed lengths of cable can also be made by the pressure extrusion process.

I claim:

1. An asymmetrically configured coaxial electrical cable comprising:

(a) an electrically conductive center conductor surrounded by a layer of porous insulation, said insulation layer being further surrounded by a layer of non-porous insulation;

(b) an electrically conductive drain wire positioned parallel to said center conductor along the length of said conductor outside said non-porous insulation layer;

(c) said insulation layers and said drain wire surrounded as a unit by a cigarette-wrapped electrically conductive shield, said drain wire being closely enfolded within said shield, and (d) said shield surrounded by an asymmetrically configured pressure-extruded polymeric jacket having a differently shaped asymmetric corner or edge thereof aligned parallel to, and in a predictable relationship to said drain wire.

2. A cable of claim 1 wherein said porous insulation layer comprises expanded polytetrafluoroethylene.

3. A cable of claim 2 wherein said shield comprises a conductive metal foil.

4. A cable of claim 2 wherein said shield comprises a metallized polymer tape.

5. A cable of claim 2 wherein said jacket comprises in cross-section the shape of a polygon having an odd number of sides.

6. A cable of claim 2 wherein the velocity of signal propagation of a signal transmitted through said cable is at least 75% of the velocity of light as determined by time domain reflectometry methods.

7. A cable of claim 2 wherein said jacket comprises in cross-section a shape embodying a circular arcuate portion and two planar portions which combine to form an edge or corner to said jacket in parallel alignment with said drain wire.

8. An assembly comprising a plurality of coaxial electrical cables of claim 1 adhered together to form a multiconductor cable.

9. An assembly of claim 8 wherein said cables are adhered by heat fusion or an adhesive.

10. An asymmetrically configured coaxial electrical cable comprising:

(a) an electrically conductive center conductor surrounded by a layer of expanded polytetrafluoroethylene insulation, said insulation layer being further surrounded by a layer of non-porous insulation:

(b) an electrically conductive drain wire positioned parallel to said center conductor along the length of said conductor outside said non-porous insulation layer;

(c) said insulation layers and said drain wire surrounded as a unit by cigarette-wrapped electrically conductive shield, said drain wire being closely enfolded within said shield; and (d) said shield surrounded by an asymmetrically configured pressure-extruded five-sided polymer jacket having a differently shaped asymmetric corner or edge thereof aligned parallel to said drain wire.

* * * * *